US006462466B1

(12) United States Patent
Sugawara et al.

(10) Patent No.: US 6,462,466 B1
(45) Date of Patent: Oct. 8, 2002

(54) COLOR CATHODE RAY TUBE WITH SMALL NECK DIAMETER AND LARGE STEM PIN CIRCLE HAVING SUFFICIENT NUMBER OF CONDUCTIVE LEAD PIN SEGMENTS

(75) Inventors: Shigeru Sugawara, Kodama-gun; Hiroyuki Koba, Fukaya; Fumitaka Hoshino, Sawa-gun; Hidenori Takata, Ibo-gun; Masatoshi Ichikawa, Gyoda, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/415,058

(22) Filed: Oct. 12, 1999

(30) Foreign Application Priority Data

Oct. 12, 1998 (JP) ..... 10-289306
Jan. 18, 1999 (JP) ..... 11-009128

(51) Int. Cl.[7] ..... H01J 31/00

(52) U.S. Cl. ..... 313/477 R; 313/477 HC; 313/482; 313/318.01; 313/318.05; 439/602; 439/617; 439/618

(58) Field of Search ..... 313/477 R, 318.01, 313/318.05, 318.06, 477 HC, 461, 466, 482; 439/602, 618, 617

(56) References Cited

U.S. PATENT DOCUMENTS 4,379,978 A * 4/1983 Hockenbrock ..... 313/318
5,818,155 A * 10/1998 Kawamura et al. .... 313/318.05
5,994,830 A * 11/1999 Nose et al. ..... 313/477 HC
6,222,311 B1 * 4/2001 Nose et al. ..... 313/477 HC
6,246,161 B1 * 6/2001 Kawamura et al. .... 313/318.05

FOREIGN PATENT DOCUMENTS

JP 58-32327 2/1983
JP 10188860 A * 7/1998 ..... H01J/29/90
JP 10321164 A * 12/1998 ..... H01J/29/90

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

In a color cathode ray tube, inner lead pin segments which extend inside the neck of a funnel constituting an vacuum envelope, outer lead pin segments which are led out of the neck and interconnecting wires which respectively connect both lead pin segments together are provided in a stem for sealing the end portion of the neck. The inner lead pin segments are arranged along a first circumference and are supported by respective projections protruding from the stem. The outer lead pin segments are arranged along a second circumference having a larger diameter than that of the first circumference. The inner lead pin segments are connected to the respective outer lead pin segments by the respective interconnecting wires which are bent in the stem and the respective projections.

14 Claims, 3 Drawing Sheets

COLOR CATHODE RAY TUBE WITH SMALL NECK DIAMETER AND LARGE STEM PIN CIRCLE HAVING SUFFICIENT NUMBER OF CONDUCTIVE LEAD PIN SEGMENTS

BACKGROUND OF THE INVENTION

The present invention relates to a color cathode ray tube, and, more particularly, to a color cathode ray tube which can reduce deflection electric power and has improved focusing characteristics to increase the resolution of a display image on the color cathode ray tube.

A color cathode ray tube generally has a panel, a funnel connected to this panel, and a vacuum envelope comprised of a stem which is welded to the end of the cylindrical neck of the funnel. Disposed in the neck of the funnel is an electron gun assembly that emits three electron beams. Those electron beams are deflected by magnetic fields, which are generated by horizontal and vertical deflection coils of a deflection yoke mounted on the funnel, to be directed via a shadow mask toward a phosphor screen which is comprised of a three-color phosphor layer and provided on the inner surface of the panel. As this phosphor screen is scanned horizontally and vertically with the electron beams, a color image is displayed.

Of such color cathode ray tubes, a currently leading one is an in-line type which emits a line of three electron beams that pass the same plane of the electron gun, and, what is more, a self-convergence type which generates a pin-cushion magnetic field from the horizontal deflection coil of the deflection yoke and a barrel magnetic field from the vertical deflection coil and can converge a line of three electron beams on anywhere on the screen without any compensation circuitry is widely put to a practical use.

Generally, about 35% of the electric power consumed by a color cathode ray tube is horizontal deflection electric power, about 10% is vertical deflection electric power and about 45% is consumed by the deflection yoke. To decrease the power consumption of color cathode ray tubes, therefore, it is most effective to reduce the power consumption of the deflection yoke.

One way of reducing the power consumption is to make the neck to be attached to the deflection yoke thinner to place the horizontal and vertical deflection coils closer to the electron beams.

FIG. 1 shows a relationship between the outside diameter of the neck and the horizontal deflection electric power in a typical color cathode ray tube with a deflection angle of 90° and the neck's outside diameter of 29.1 mm. As indicated by a straight line 1 in FIG. 1, the horizontal deflection electric power is substantially increased in proportion to the neck's outside diameter, and making the neck's outside diameter to 22.5 mm can reduce the horizontal deflection electric power to about 80% of what is consumed in a case of the neck having an outside diameter of 29.1 mm.

With the deflection angle being the same, the overall length of a color cathode ray tube gets longer as the screen size becomes larger. In general, the overall length of a color cathode ray tube is made shorter by increasing the deflection angle which however results in increased deflection electric power. With the neck's outside diameter of 29.1 mm, for example, setting the deflection angle to 100° increases the horizontal deflection electric power to 135% of the power consumed when the deflection angle is 90°, as indicated by a point 2 in FIG. 1. With the neck's outside diameter of 22.5 mm, however, even when the deflection angle is set to 100°, an increase in horizontal deflection electric power can be suppressed to 108% of the power consumed in the case of the deflection angle of 90°, as indicated by a point 3 in FIG. 1.

The aforementioned increase in deflection electric power not only leads to an increase in consumed energy but also raises the following problems. Particularly, for a tube with a deflection angle of 90° and deflection electric power greater than 110% of the deflection electric power of the standard tube with the neck's outside diameter of 29.1 mm, the cost for the circuitry which maintains the reliability of the deflection power supply circuit, such as the breakdown voltage characteristic and temperature characteristic, is increased significantly. Further, the leak magnetic field from the deflection yoke increases, which requires an improvement on the performance of a device which suppresses this increase. Those two problems lead to an increase in the overall cost of the apparatus that drives a color cathode ray tube. Furthermore, as the amount of heat generated by the iron loss and copper loss of the deflection yoke increases, it is necessary to enhance the heat generating characteristic of the deflection yoke itself. This leads to enlargement of the deflection yoke and an increase in the number of members used therein.

In view of the above, it is desirable to suppress an increase in deflection electric power to 10% or less of the power consumption of the standard tube, and with a deflection angle of 100°, the outside diameter of the neck should desirably be set to 23.2 mm or smaller.

Reducing the neck's outside diameter limits the number of potentials to be supplied to the electrodes of the electron gun disposed in the neck so that the desired focusing performance will not be exhibited, resulting in an insufficient resolution.

In other words, the aforementioned, self-convergence in-line type color cathode ray tube generates non-uniform magnetic fields, a pin-cushion type horizontal deflection magnetic field and a barrel type vertical deflection magnetic field, the electron beams are affected by the deflection defocusing to form deformed beam spots on the peripheral portion of the screen, thus reducing the resolution. To overcome this problem, the self-convergence in-line type color cathode ray tube uses a dynamic focusing electron gun which changes the focusing voltage for the electron gun in synchronism with the deflection of the electron beams and apply the changed voltage to the multi-pole lens that is formed by the electron gun to thereby compensate for the deflection difference.

FIG. 2 shows a typical dynamic focusing electron gun. This electron gun comprises three cathodes KB, KG and KR for generating three electron beams in a line to cause light rays emitted from the three-color phosphor layer which constitutes the phosphor screen, three heaters HB, HG and HR for respectively heating the cathodes KB, KG and KR, an integral assembly of a first grid G1, a second grid G2, a third grid G3, a fourth grid G4, first and second segment electrodes G51 and G52 of a fifth grid G5 and a sixth grid G6 which are arranged in the named order from the cathodes KB, KG and KR toward the phosphor screen, and a shield cup C attached to the sixth grid G6.

A voltage obtained by superimposing a video signal on a DC voltage of about 150V is applied to the three cathodes KB, KG and KR via three respective conductive wires 7 provided at a stem 6 which seals the end portion of a neck 5, and a heater voltage of about 6.3V is applied to the three heaters HB, HG and HR via two respective conductive wires 7. A ground potential or a potential close to the ground one is applied to the first grid G1 via one conductive wire 7. A voltage of 500V to 900V is applied via one conductive wire 7 to the second grid G2 and the fourth grid G4, which are connected together in the tube. A focus adjusting voltage of 6 KV to 9 KV which adjusts the focus states of the electron beams is applied via one conductive wire 7 to the first segment electrode G51 of the fifth grid G5. A dynamic focusing voltage, obtained by superimposing a voltage which varies in synchronism with the deflection of the electron beams on a DC voltage of 6 KV to 9 KV, is applied via one conductive wire 7 to the second segment electrode G52 which is connected to the third grid G3 in the tube. The application of the dynamic focusing voltage changes the strength of the multi-pole lens formed between the second segment electrode G52 and the first segment electrode G51 and the strength of the main lens formed between the second segment electrode G52 and the sixth grid G6, thereby adjusting the focus states of the electron beams and, at the same time, compensating for the deflection defocusing that is produced by the deflection magnetic field in synchronism with the deflection of the electron beams. A voltage of about 25 KV is applied to the sixth grid G6 via the anode terminal provided in the funnel, an inner conductive film 8 coated on the inner surface of the funnel and a bulb spacer 9 which is attached to the shield cup C and abuts on the inner conductive film 8.

Apparently, the color cathode ray tube that is equipped with such a dynamic focusing electron gun requires nine types of voltages to be supplied to the electron gun via the conductive lead pin segments 7 provided in the stem 6.

A conventional stem for the neck's outside diameter of 29.1 mm has ten conductive lead pin segments and can use two of them to supply the focus adjusting voltage and the dynamic focusing voltage. A stem for the neck's outside diameter of 22.5 mm however has only eight conductive lead pin segments and is unable to supply the dynamic focusing voltage. Making the neck thinner cannot therefore improve the focusing performance of the electron gun sufficiently, disabling acquisition of the desired resolution.

As one solution to this problem, the number of conductive lead pin segments may be increased without changing the layout diameter of the conductive lead pin segments arranged on the same circumference. Increasing the number of conductive lead pin segments however results in an incompatibility with other types of color cathode ray tubes and impairs the general-purpose designing capability.

Jpn. Pat. Appln. KOKAI Publication No. 8-148103 discloses, as another solution, a method of making the inside diameter of the neck to 19.1 mm to 23.1 mm and the layout diameter of the conductive lead pin segments of the stem to 12.2 mm to 15.3 mm.

Since the thickness of the neck generally made of glass should be 2 mm or thicker in view of the breakdown voltage characteristic and the mechanical strength, the outside diameter of the neck becomes 23.1 mm to 27.1 mm according to this method. With regard to reduction of the deflection electric power, in the aforementioned case of the deflection angle being 100°, an increase in horizontal deflection electric power becomes equal to or greater than 10% of the power consumption of the tube. The reduction in the consumed power of the color cathode ray tube is insufficient.

Jpn. Pat. Appln. KOKAI Publication No. 10-83781 describes a problem of producing cracks in the stem-neck weld when a stem for the standard diameter of 15.24 mm in a case where conductive lead pin segments are laid in a stem for a neck's outside diameter of 29.1 mm is welded to a neck whose outside diameter is smaller than 29.1 mm. This publication discloses a method of overcoming this problem by locally increasing the inside diameter of the neck in order by making the stem-welding portion of the neck thinner to thereby provide a gap of 2.1 mm between the projections surrounding the inner lead pin segments and the inner wall of the neck.

This method however lowers the mechanical strength of the neck, making the neck easier to break or making it easier to produce cracks therein. This leads to a lower reliability, such as the degree of vacuum becoming lower during operation of the color cathode ray tube and an abnormal current flowing in the power supply circuit due to the discharge in the tube, damaging the display apparatus.

Jpn. Pat. Appln. KOKAI Publication No. 58-32327 discloses a way of preventing cracks on the weld between the neck and the stem, which is accomplished by widening the gap between the projections surrounding the inner lead pin segments and the inner wall of the neck by making the layout diameter of the inner lead pin segments of the stem smaller than the layout diameter of the outer lead pin segments.

This publication however fails to specifically describe how to widen the gap between the projections surrounding the inner lead pin segments and the inner wall of the neck without impairing the reliability of the cathode ray tube.

As mentioned above, to decrease the power consumption of a color cathode ray tube, it is effective to reduce the power consumption of the deflection yoke by making the neck thinner to position the horizontal and vertical deflection coils of the deflection yoke closer to the electron beams. A dynamic focusing electron gun which has an excellent focusing characteristics can provide a high resolution. If the neck of this gun is made thinner, the number of potentials to be supplied to the dynamic focusing electron gun becomes insufficient, so that the resolution cannot be improved.

As one solution to this problem, the conductive lead pin segments in the stem may be increased without changing the layout diameter of the conductive lead pin segments. Increasing the number of conductive lead pin segments however results in an incompatibility with other types of color cathode ray tubes and impairs the general-purpose designing capability.

Another solution has been proposed, which makes the inside diameter of the neck to 19.1 mm to 23.1 mm and the circular layout diameter of the conductive lead pin segments of the stem to 12.2 mm to 15.3 mm. The thickness of the neck generally made of glass should be 2 mm or thicker in view of the breakdown voltage characteristic and the mechanical strength. It is pointed out that in this case, the neck then would have an outside diameter of 23.1 mm to 27.1 mm, which results in an insufficient reduction in the consumed power of the color cathode ray tube.

To avoid cracks in the stem-neck weld when a stem for the standard diameter of 15.24 mm in a case where conductive lead pin segments are laid in a stem for a neck's outside diameter of 29.1 mm is welded to a neck whose outside diameter is smaller than 29.1 mm, a method of locally increasing the inside diameter of the neck by making the stem-welding portion of the neck thinner has been proposed. This method however decreases the mechanical strength of the neck, making the neck easier to break or making it easier to produce cracks therein.

As a solution to such production of cracks on the weld between the neck and the stem, there has been proposed a method of widening the gap between the projections surrounding the inner lead pin segments and the inner wall of the neck by making the circular layout diameter of the inner lead pin segments of the stem smaller than the circular layout diameter of the outer lead pin segments. This proposal however fails to include a specific description of how the gap between the projections surrounding the inner lead pin segments and the inner wall of the neck is widened without impairing the reliability of the cathode ray tube.

SUMMARY OF THE INVENTION

Accordingly, it is an object of the present invention to provide a reliable, low-power-consumption and high-resolution color cathode ray tube which has deflection electric power reduced by making the neck thinner and has improved focusing characteristics for electron beams and a compatibility with other types of color cathode ray tubes.

(1) In a color cathode ray tube comprising a stem structure whose stem seals the end portion of the neck of a funnel constituting an vacuum envelope and is welded to the neck, an exhaust tube provided integrally on the center axis of the stem structure and led out of the end portion of the neck, a plurality of conductive wires which include inner lead pin segments electrically insulated from one another and penetrating the same circumference around the center axis of the stem structure to be positioned inside the neck, and outer lead pin segments positioned outside the end portion of the neck, and which supply voltages to be applied to the heaters, cathodes and a plurality of electrodes of an electron gun assembly placed in the neck, and projections provided integrally on the stem structure and surrounding those portions of the inner lead pin segments which are positioned near the stem structure, at least a part of each conductive wire is bent in the associated projection, the bent portion of this conductive wire is directed outward in the radial direction of the stem with respect to the center axis of the projection, and the diameter of the first circumference along which the inner lead pin segments are arranged is set smaller than that of the second circumference along which the outer lead pin segments are arranged.

(2) In the color cathode ray tube as recited in paragraph (1), the diameter of the first circumference is set smaller than that of the second circumference by 0.3 mm to 2.2 mm.

(3) In the color cathode ray tube as recited in paragraph (1) or (2), the diameter of the first circumference is set within a range of 12.8 mm to 14.7 mm and the diameter of the second circumference is set within a range of 15.0 mm to 15.5 mm.

(4) In a color cathode ray tube comprising a stem structure whose stem seals the end portion of the end portion of the neck of a funnel constituting an vacuum envelope and is welded to the neck, an exhaust tube provided integrally on the center axis of the stem structure and led out of the end portion of the neck, a plurality of conductive wires which include inner lead pin segments electrically insulated from one another and penetrating the same circumference around the center axis of the stem structure to be positioned inside the neck, and outer lead pin segments positioned outside the end portion of the neck, and which supply voltages to be applied to the heaters, cathodes and a plurality of electrodes of an electron gun assembly placed in the neck, and projections provided integrally on the stem structure and surrounding those portions of the inner lead pin segments which are positioned near the stem structure, at least a part of each conductive wire is bent in the associated projection, the bent portion of this conductive wire is directed outward in the radial direction of the stem with respect to the center axis of the projection, the diameter of the first circumference along which the inner lead pin segments are arranged is set smaller than that of the second circumference along which the outer lead pin segments are arranged, and a gap between each of the projections and the inner surface of the neck at a middle of the height of that projection with a curved portion or an inflexion portion of the inner surface of the stem structure, which extends toward the exhaust tube from the projection, taken as a reference is set equal to or greater than 0.5 mm.

(5) In a color cathode ray tube comprising a stem structure whose stem seals the end portion of the end portion of the neck of a funnel constituting an vacuum envelope and is welded to the neck, an exhaust tube provided integrally on the center axis of the stem structure and led out of the end portion of the neck, a plurality of conductive wires which include inner lead pin segments electrically insulated from one another and penetrating the same circumference around the center axis of the stem structure to be positioned inside the neck, and outer lead pin segments positioned outside the end portion of the neck, and which supply voltages to be applied to the heaters, cathodes and a plurality of electrodes of an electron gun assembly placed in the neck, and projections provided integrally on the stem structure and surrounding those portions of the inner lead pin segments which are positioned near the stem structure, at least a part of each conductive wire is bent substantially in the associated projection, the bent portion of this conductive wire in the projection is directed outward in the radial direction of the stem with respect to the center axis of the projection, the diameter of the first circumference along which the inner lead pin segments are arranged is set smaller than that of the second circumference along which the outer lead pin segments are arranged, the diameter of each projection at a middle of the height of that projection with a curved portion or inflexion portion of the inner surface of the stem structure, which extends toward the exhaust tube from the projection, taken as a reference is set equal to or greater than 2.5 mm, and a gap between each projection and the inner wall of the neck at a middle of the height of that projection is set equal to or greater than 0.5 mm.

(6) In the color cathode ray tube as recited in paragraph (4) or (5), the diameter of the first circumference is set within a range of 12.8 mm to 14.7 mm, the diameter of the second circumference is set within a range of 15.0 mm to 15.5 mm and the inside diameter of the neck is set within a range of 17.8 mm to 19.2 mm.

(7) In the color cathode ray tube as recited in paragraph (4) or (5), the diameter of the first circumference is set within a range of 12.8 mm to 14.7 mm, the diameter of the second circumference is set within a range of 15.0 mm to 15.5 mm, the inside diameter of the neck is set within a range of 17.8 mm to 19.2 mm and the outside diameter of the neck is set within a range of 21.8 mm to 23.2 mm.

(8) In the color cathode ray tube as recited in paragraph (4) or (5), each conductive wire is thinner than at least one of the inner pin segment and the outer pin segment.

(9) In the color cathode ray tube as recited in paragraph (4) or (5), a bent portion of each conductive wire is located in the respective projection by an amount ranging from 10% to 50% of the height of the projection with a curved portion or an inflexion portion of the inner surface of the stem structure, which extends toward the exhaust tube from the projection, taken as a reference.

(10) In the color cathode ray tube as recited in paragraph (4) or (5), there are nine or more conductive wires.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode ray tube according to one embodiment of the present invention will now be described with reference to the accompanying drawings.

Figure 3:
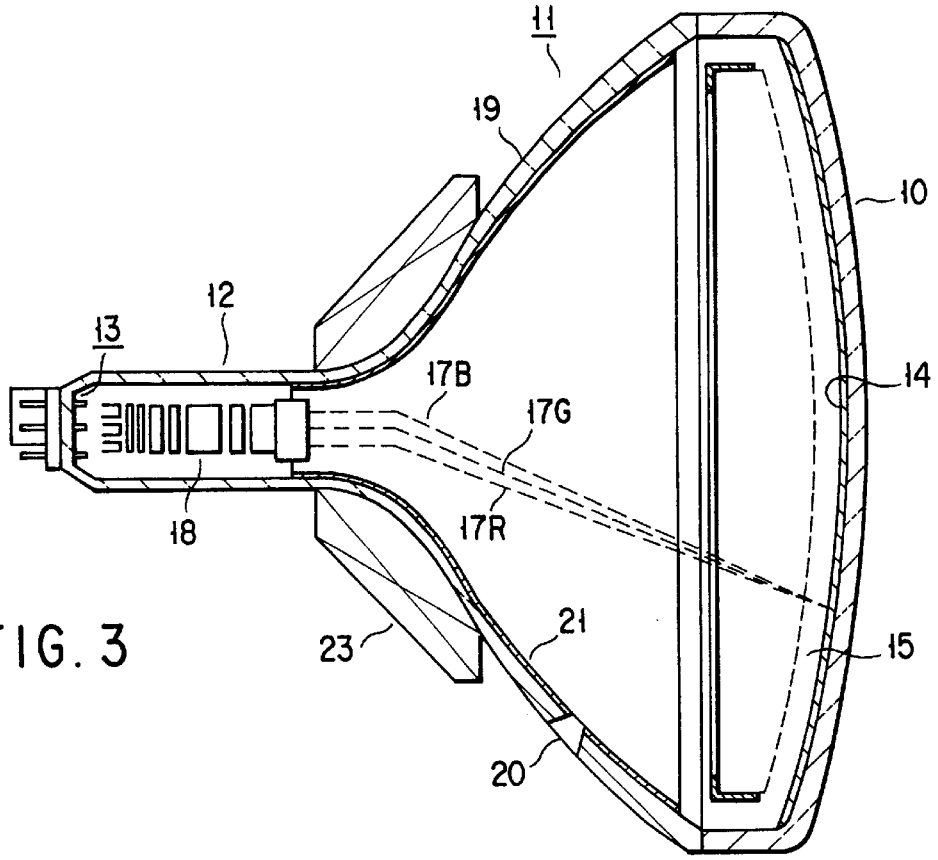
FIG. 3 is a cross-sectional view schematically illustrating the structure of a color cathode ray tube according to one embodiment of this invention.

FIG. 3 shows a color cathode ray tube according to one embodiment of this invention. This color cathode ray tube has a vacuum envelope that includes a panel 10, a funnel 11 connected to the panel 10 and a stem structure 13 which is welded to the end portion of a cylindrical neck 12 of the funnel 11 and seals the end portion of the neck 12. Provided on the inner surface of the panel 10 is a phosphor screen 14 comprised of a three-color phosphor layer which emits blue, green and red lights. A shadow mask 15 is arranged inward of the phosphor screen 14, facing the screen 14.

Figure 1:
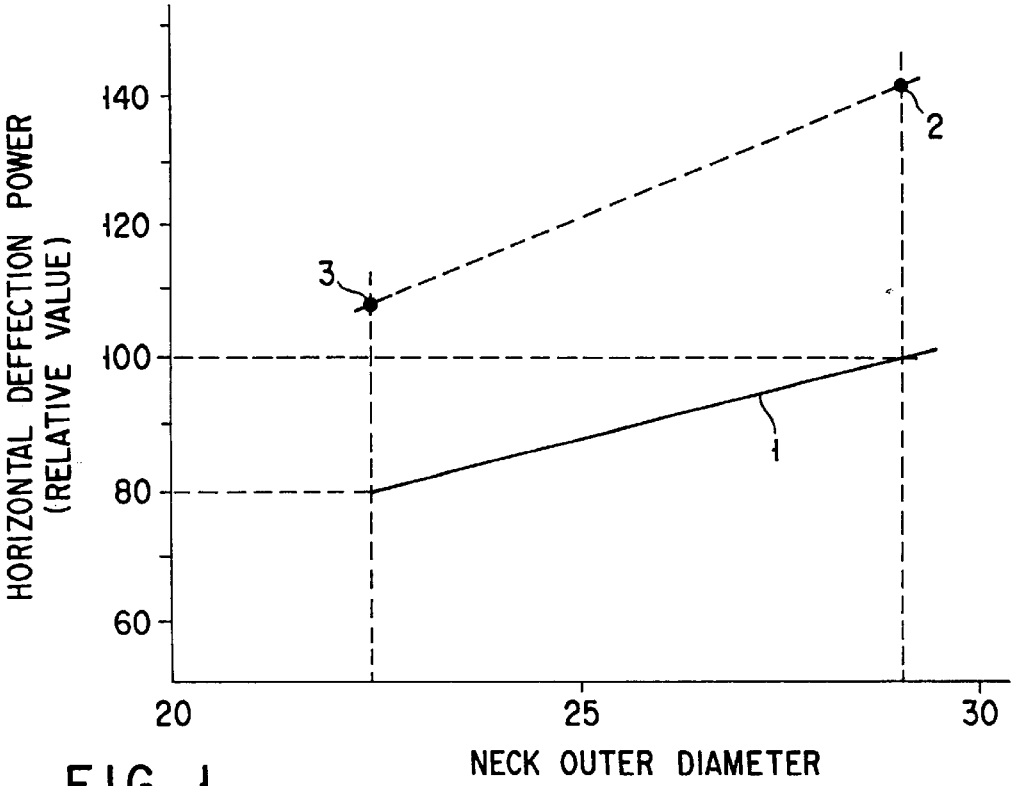
FIG. 1 BACKGROUND ART
FIG. 1 is a graph for explaining the relationship between the outside diameter of the neck of a standard color cathode ray tube and the horizontal deflection electric power.
Figure 2:
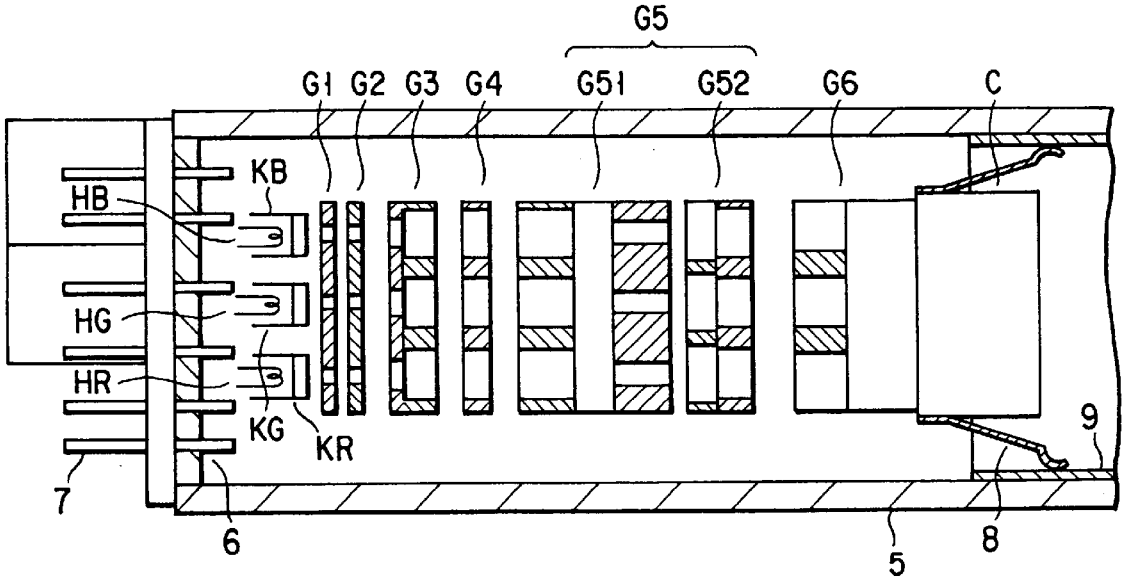
FIG. 2 BACKGROUND ART
FIG. 2 is a cross-sectional view schematically showing the structure of a dynamic focusing electron gun of an ordinary color cathode ray tube.

Disposed in the neck 12 of the funnel 11 is an electron gun assembly 18 which emits three electron beams 17B, 17G and 17R. This electron gun assembly 18 comprises three cathodes, three heaters for respectively heating those cathodes, and a plurality of electrodes sequentially arranged from the cathodes toward the phosphor screen 14. The cathodes, the heaters and those other than the electrodes that finally accelerate the electron beams 17B, 17G and 17R are connected to respective conductive wires of the stem 13 to be described later, via which predetermined voltages are supplied to the cathodes, the heaters and those other than the electrodes that finally accelerate the electron beams 17B, 17G and 17R. An anode terminal 20 is provided at a large-diameter portion 19 of the funnel 11, and an inner conductive film 21 is provided on an area from the inner surface of the large-diameter portion 19 of the funnel 11 to the inner surface of a portion adjoining to the neck 12. A predetermined voltage is supplied via the anode terminal 20 and the, inner conductive film 21 to the electrodes that finally accelerate the electron beams 17B, 17G and 17R. Since the electron gun assembly 18, which may take various structures, fundamentally has the electrode structure that has been discussed earlier with reference to FIG. 2, the structure of this electron gun assembly 18 will not be given hereunder. For the details of the structure, please refer to the foregoing description given with reference to FIG. 2.

The three electron beams 17B, 17G and 17R emitted from the electron gun 18 are deflected by a deflection yoke 23 mounted outside the funnel 11, and are directed toward the phosphor screen 14 via the shadow mask 15. As the phosphor screen 14 is scanned horizontally and vertically with those electron beams, a color image is displayed on the phosphor screen 14.

Figure 4A:
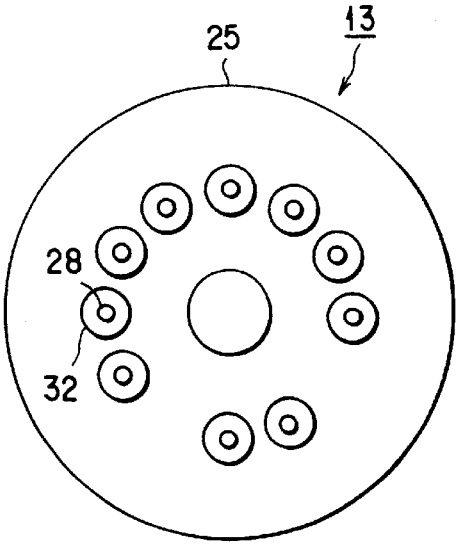
FIG. 4A is a plan view schematically showing a stem to be welded to the end portion of the neck of the color cathode ray tube shown in FIG. 3.
Figure 4B:
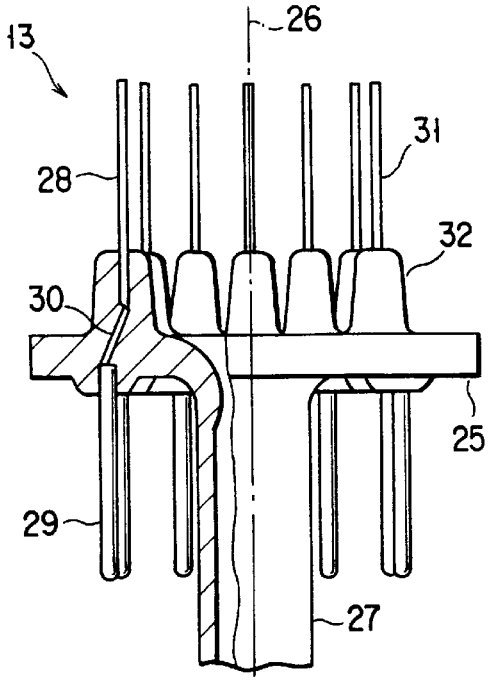
FIG. 4B is a front view showing a part of the stem in FIG. 4A in a cross-section.

FIGS. 4A and 4B show a single stem structure 13 which is not yet welded to the neck 12. As shown in FIGS. 4A and 4B, the stem structure 13 has a stem 25 to be welded to the neck 12, and an exhaust tube 27 is provided integrally on the center axis 26 of the stem 25 (which coincides with the center axis of the stem structure 13) and is led out of the end portion of the neck 12. A plurality of conductive stem pins or conductive stem wires 31 each comprised of an inner lead pin segment 28, an outer lead pin segment 29 and an interconnecting wire 30 are provided in this stem 25. The inner lead pin segments 28 constituting the conductive stem pins 31 are led inside the neck 12 in such a way as to be electrically insulated from one another and are laid on a first circumference or imaginary circle surrounding the center axis 26 of the stem 25 in such a manner as to penetrate the stem 25 in an air-tight fashion. Likewise, the outer lead pin segments 29 constituting the conductive stem pins 31 are led out of the end portion of the neck 12 in such a way as to be electrically insulated from one another and are laid on a second circumference or imaginary circle surrounding the center axis 26 of the stem 25 in such a manner as to penetrate the stem 25 in an air-tight fashion. Those lead pin segments 28 and 29 are connected together by the associated interconnecting wires 30 each made of a Dumet wire and embedded in the sealing section in the stem 13. Projections 32 which protrude inside the neck 12 are provided integrally on the stem 25, and the inner lead pin segments 28 are supported by the respective projections 32.

In this embodiment, the interconnecting wires 30 extend from the stem 25 in such a way as to be bent in the associated projections 32 that support the associated inner lead pin segments 28, and each bent portion is directed outward in the radial direction of the stem 13 with respect to the center axis of the projection 32. That is, the diameter of the circumference or imaginary circle along which the inner lead pin segments 28 are laid is set smaller than the diameter of the circumference or imaginary circle along which the outer lead pin segments 29 are laid, so that each interconnecting wire 30 is bent outward in the radial direction of the stem 13 with respect to the center axis of the associated projection 32 in order to couple both lead pin segments 28 and 29, and extends from the end portion of the associated inner lead pin segment 28 to the associated outer lead pin segment 29.

With the stem structure 13 designed to have the above-described structure, even if the diameter of the neck is made smaller, it is still possible to set a gap between the inner wall of the neck 12 and each projection 32 equal to or greater than 0.5 mm, thereby preventing cracks from being produced in the weld between the neck 12 and the stem 13 due to a heat shock applied in the manufacturing steps of the color cathode ray tube or the like.

It is understood from the studies the present inventors have made that in a case where the stem structure is welded to the neck to seal the end portion of the neck, when the inner surface of the neck comes closer to the projections enclosing the inner lead pin segments, the gap between the neck and each projection becomes an approximately V-shaped groove such that stress is concentrated on this groove when a heat shock is applied, and a crack may be produced starting from this groove. This fact is described in Jpn. Pat. Appln. KOKAI Publication No. 58-32327.

Figure 5:
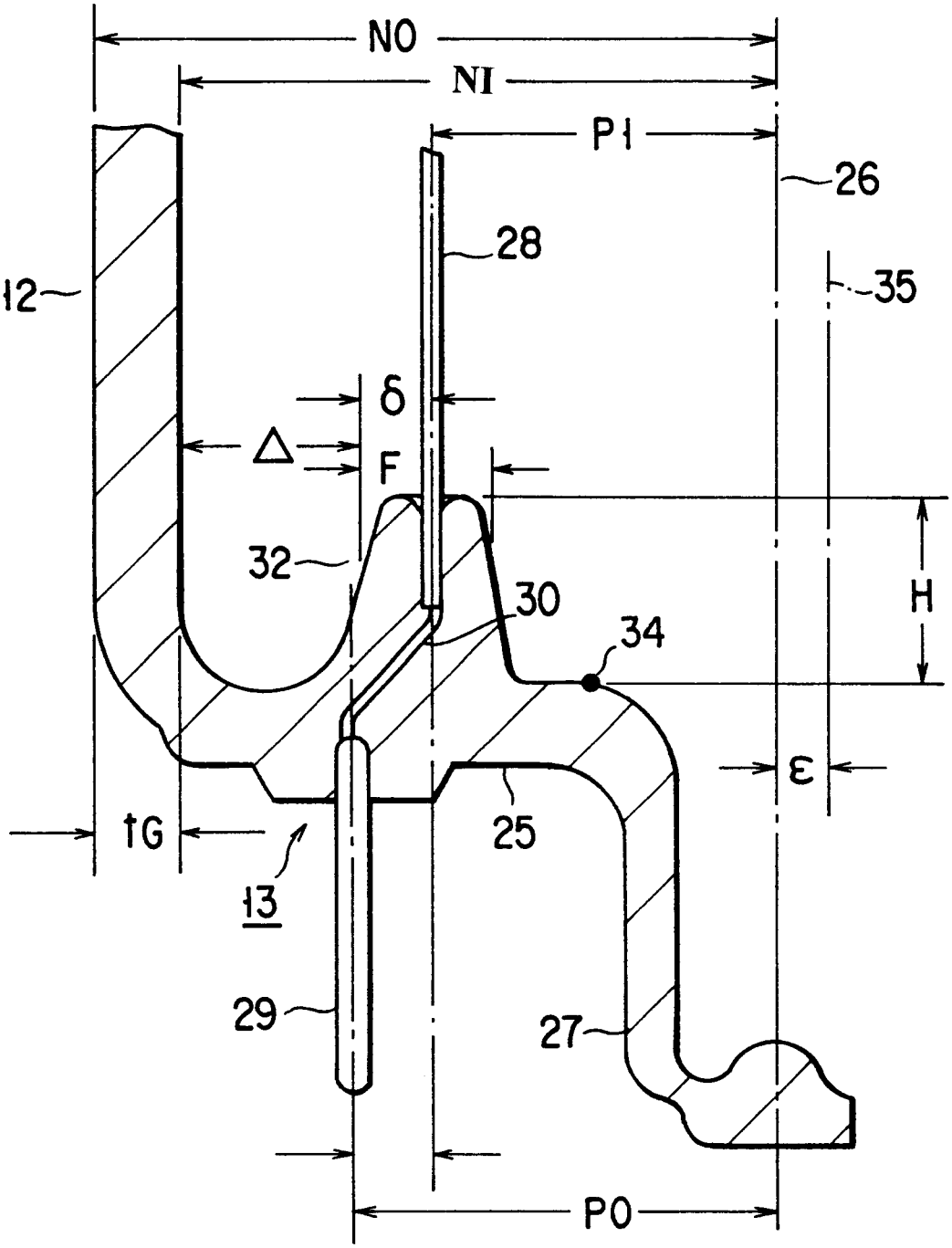
FIG. 5 is a cross-sectional view schematically illustrating the structure of a weld between the end portion of the neck of the color cathode ray tube shown in FIG. 3 and the stem.

The present inventors also found out that if the gap between the inner surface of the neck and the projections is set equal to or greater than 0.5 mm, as shown in FIG. 5, the gap between the neck 12 and each projection 32 does not have a V shape so that even with a heat shock applied, it is possible to avoid concentration of stress, thus preventing production of cracks.

The dimensions of the individual portions that are needed to make the gap between the inner surface of the neck 12 and the projections 32 to 0.5 mm or greater will now be discussed referring to an equation (1) and a table given below.

$$NI=NO-2tG$$

$$P1=P0-2\delta$$

where, as seen from FIG. 5,

NO: the outside diameter of the neck 12, tG: the thickness of the neck 12, NI: the inside diameter of the neck 12,

P0: the diameter of the second circumference or imaginary circle along which the outer lead pin segments 29 are laid in the stem 13, δ: a value by which each interconnecting wire 30 of the conductive wire is bent along the radial direction of the neck,

P1: the diameter of the first circumference or imaginary circle along which the inner lead pin segments 28 are laid in the stem 13, H: the height of each projection 32 measured with a curved portion or inflexion portion 34 of the inner surface of the stem 25 taken as a reference, F: the diameter of the circumference along which the projections 32 are laid at a height H/2, ϵ: the amount of axial deviation between the center axis of the neck 12 and the center axis 26 of the stem 13, and Δ: the gap between the inner surface of the neck 12 and each projection 32.

Thus, the gap between the inner surface of the neck 12 and each projection 32 is expressed by the following equation (1).

$$\Delta=\{(NO-2tG)-(P0-2\delta)-F\}/2-\epsilon=(NI-P1-F)/2-\epsilon \quad (1)$$

The curved portion or inflexion portion 34 of the inner surface of the stem 25 with the height H of the projection 30 as a reference means a position at which the curvature of the inner surface of the stem 25 which extends toward the exhaust tube 27 from the surface of the projection 32 on that side of the center axis 26 of the stem 13. The reason for defining the curved portion or inflexion portion 34 is that when the stem 13 is welded to the neck 12, the shape of the stem 13 is changed to a complicated one and the boundary between the neck 12 and the stem 13 becomes unclear as shown in FIG. 5, disabling the stem 13 from being clearly distinguished from the neck 12.

The following table shows values of the gap Δwhen the parameters in the equation (1) are changed. This table shows data of the first group (a) to the tenth group (f2, f2). For the first group (a) to the tenth group (f2, f2), the thickness (tG) of the neck 12 and the diameter (F) of the circumference along which the projections are laid are constant and are respectively 2.0 mm and 2.5 mm. For the first group (a) to the eighth group (e2, e2, e2), the outside diameter of the neck (NO) and the inside diameter of the neck (NI) are respectively set to 23.2 mm and 19.2 mm, whereas for the ninth group (f1, f1) to the tenth group (f2, f2), the outside diameter of the neck (NO) and the inside diameter of the neck (NI) are respectively set to 21.8 mm and 17.8 mm, smaller than those for the first group (a) to the eighth group (e2, e2, e2). The table shows the values of the gap Δ when the diameter P1 of the first circumference and the diameter P0 of the second circumference are varied under the above conditions.

| | N1 (mm) | N0 (mm) | tG (mm) | δ (mm) | P0 (mm) | P1 (mm) | F (mm) | ϵ (mm) | Δ (mm) |
|---|---|---|---|---|---|---|---|---|---|
| (a) | 19.2 | 23.2 | 2.0 | 0.00 | 15.24 | 15.24 | 2.5 | 0.00 | 0.73 |
| (b1) | 19.2 | 23.2 | 2.0 | 0.00 | 15.00 | 15.00 | 2.5 | 0.00 | 0.85 |
| (b1) | 19.2 | 23.2 | 2.0 | 0.00 | 15.24 | 15.24 | 2.5 | 0.00 | 0.73 |
| (b1) | 19.2 | 23.2 | 2.0 | 0.00 | 15.50 | 15.50 | 2.5 | 0.00 | 0.60 |
| (b2) | 19.2 | 23.2 | 2.0 | 0.00 | 15.00 | 15.00 | 2.5 | 0.50 | 0.35 |
| (b2) | 19.2 | 23.2 | 2.0 | 0.00 | 15.24 | 15.24 | 2.5 | 0.50 | 0.23 |
| (b2) | 19.2 | 23.2 | 2.0 | 0.00 | 15.50 | 15.50 | 2.5 | 0.50 | 0.10 |
| (c) | 19.2 | 23.2 | 2.0 | 1.10 | 15.24 | 13.04 | 2.5 | 0.00 | 1.83 |
| (d1) | 19.2 | 23.2 | 2.0 | 1.10 | 15.00 | 12.80 | 2.5 | 0.00 | 1.95 |
| (d1) | 19.2 | 23.2 | 2.0 | 1.10 | 15.24 | 13.04 | 2.5 | 0.00 | 1.83 |
| (d1) | 19.2 | 23.2 | 2.0 | 1.10 | 15.50 | 13.30 | 2.5 | 0.00 | 1.70 |
| (d2) | 19.2 | 23.2 | 2.0 | 1.10 | 15.00 | 12.80 | 2.5 | 0.50 | 1.45 |
| (d2) | 19.2 | 23.2 | 2.0 | 1.10 | 15.24 | 13.04 | 2.5 | 0.50 | 1.33 |
| (d2) | 19.2 | 23.2 | 2.0 | 1.10 | 15.50 | 13.30 | 2.5 | 0.50 | 1.20 |
| (e1) | 19.2 | 23.2 | 2.0 | 0.15 | 15.00 | 14.70 | 2.5 | 0.00 | 1.00 |
| (e1) | 19.2 | 23.2 | 2.0 | 0.27 | 15.24 | 14.70 | 2.5 | 0.00 | 1.00 |
| (e1) | 19.2 | 23.2 | 2.0 | 0.40 | 15.50 | 14.70 | 2.5 | 0.00 | 1.00 |
| (e2) | 19.2 | 23.2 | 2.0 | 0.15 | 15.00 | 14.70 | 2.5 | 0.50 | 0.50 |
| (e2) | 19.2 | 23.2 | 2.0 | 0.27 | 15.24 | 14.70 | 2.5 | 0.50 | 0.50 |
| (e2) | 19.2 | 23.2 | 2.0 | 0.40 | 15.50 | 14.70 | 2.5 | 0.50 | 0.50 |
| (f1) | 17.8 | 21.8 | 2.0 | 1.10 | 15.50 | 13.30 | 2.5 | 0.00 | 1.00 |
| (f1) | 17.8 | 21.8 | 2.0 | 1.10 | 15.00 | 12.80 | 2.5 | 0.00 | 1.25 |
| (f2) | 17.8 | 21.8 | 2.0 | 1.10 | 15.50 | 13.30 | 2.5 | 0.50 | 0.50 |
| (f2) | 17.8 | 21.8 | 2.0 | 1.10 | 15.00 | 12.80 | 2.5 | 0.50 | 0.75 |

As discussed in the foregoing description of the prior art, even if the deflection angle is increased in order to shorten the entire length of the cathode ray tube, the allowable increase in deflection electric power is within about 10% of the deflection electric power of the standard tube that has an deflection angle of 90° and a neck's outside diameter NO of 29.1 mm, and for an deflection angle of 100°, it is desirable to set the neck's outside diameter NO to 23.2 mm or smaller. In a case where a conventional stem which is generally used for such a neck and has ten conductive wires laid on a circumference having a diameter of P0=P1=15.24 mm (the diameters of the first and second circumferences are equal to each other) is welded to the neck without any axial deviation, the minimum thickness tG of the neck is set to 2.0 mm from the viewpoints of the breakdown voltage characteristic and the mechanical strength. The minimum diameter F of the circumference along which the projections of the stem are arranged is 2.5 mm from the viewpoint of the support strength of the inner lead pin segments. In this case, because there is no axial deviation between the stem and the neck and $\epsilon=0$, from the equation (1), the gap $\Delta$ becomes $$\Delta=0.73 \text{ mm}$$

as seen in the first group (a). It is thus possible to set the gap $\Delta$ equal to or smaller than the aforementioned value of 0.5 mm.

Actually, however, the diameter of the circumference (P1=P0) along which the conductive wires are laid varies from 15.0 mm to 15.5 mm. Further, an axial deviation of 0.5 mm at a maximum exists between the stem and the neck due to the axial deviation of the apparatus for manufacturing the color cathode ray tube, thermal expansion, etc. In consideration of those points, therefore, the gap $\Delta$ between the inner surface of the neck and each projection becomes 0.1 mm to 0.35 mm, smaller than 0.5 mm, as shown in the third group (b2, b2, b2) in the table, making it difficult to avoid heat-shock originated occurrence of cracks. It is to be noted that the second and third groups (b1, b1, b1, b2, b2, b2) in the table, like the first group, show the results of a case where the diameters of the first and second circumferences are identical (P1=P0).

When the interconnecting wire 30 of the conductive wire 31 is bent outward in the radial direction with respect to the center axis 26 of the stem 25 and the layout diameter P1 of the inner lead pin segments 28 is set smaller than the layout diameter P0 of the outer lead pin segment 29 (P1<P0) as for the stem 13 of this embodiment, the gap $\Delta$ between the inner surface of the neck 12 and each projection 32 can be set equal to or greater than 0.5 mm even if the layout diameter P0 of the outer lead pin segment 29 is set to15.24 mm.

If the interconnecting wire 30 is made thinner than the inner lead pin segment 28 or the outer lead pin segment 29 and is formed of a Dumet or Dux wire, which is obtained by covering a wire of 42 alloy with a low thermal expansion coefficient or a similar metal wire with cuprous oxide ($Cu_2O$) and then further covering the resultant wire with sodium borate ($Na_2B_4O_7$) in a thickness of several microns and is flexible, the interconnecting wire 30 can be bent easily. If the Dumet wire is bent with a large curvature, however, the cuprous oxide coat is separated and the air-tight sealing with respect to glass may be gone, which may result in a reduction in the degree of vacuum of the vacuum envelope. If the Dumet wire is bent with a large radius of curvature (small curvature), on the other hand, it is necessary to make thicker a part of the stem structure which surrounds the bent portion of the Dumet wire or make each projection taller. This increases a difference between the thermal capacitance of the stem and that of the neck, thus making it easier to produce cracks in the stem structure and the projections while the neck is welded to the stem.

If the interconnecting wire 30 is bent with a large curvature from the stem 25 to a part of the projection 32 and is made of a flexible Dumet wire thinner than the inner lead pin segment 28 or the outer lead pin segment 29 as in this embodiment, when the interconnecting wire 30 is positioned in the projection 32 outward from the center axis of the projection 32 with respect to the center axis 26 of the stem 25, the thickness (diameter) of the projection 32 that encloses the interconnecting wire 30 can be increased even, thus securing a sufficient vacuum state and a sufficient mechanical strength for the portion that supports the interconnecting wire 30. This can allow the projections 32 to be formed closer to the center axis 26 of the stem 25, thus providing a larger distance between the inner wall of the neck and the projections 32.

The results of the studies made by the present inventors show that the appropriate length of the interconnecting wire 30 is 2.5 mm to 4.0 mm, and the allowable amount of bending $\delta$ then is 1.1 mm over which the coat of the Dumet wire would be separated.

In short, tG=2.0 mm or greater,

P0 15.0 mm to 15.5 mm,

F=2.5 mm or greater, $\delta$=1.1 mm or smaller, and $\epsilon$=0.5 mm or smaller.

Under the above conditions, when the neck 12 is given an outside diameter NO of 23.2 mm, the layout diameter P0 of the outer lead pin segments 29 is set to 15.24 mm, the same as the layout diameter of the conductive wires of the conventionally typical stem which has ten conductive wires, and the interconnecting wires 30 each made of a Dumet wire are bent with the allowable bending amount $\delta$ of 1.1 mm, the gap $\Delta$ between the inner surface of the neck 12 and each projection 32 can be set to 1.83 mm, greater than 0.5 mm, as shown in the fourth group (c) in the table, if there is no axial deviation between the neck 12 and the stem 13.

If the layout diameter P0 of the outer lead pin segments 29 is set within a variation of 15.0 mm to 15.5 mm, the gap $\Delta$ between the inner surface of the neck 12 and each projection 32 can be set to 1.20 mm to 1.45 mm, greater than 0.5 mm, as shown in the sixth group (d2, d2,d2) in the table, even when the axial deviation $\Delta$ between the neck 12 and the stem 13 is the maximum of 0.5 mm.

Further, the bending amount $\delta$ of the interconnecting wire 30 that is needed to set the gap $\Delta$ between the inner surface of the neck 12 and each projection 32 to 0.5 mm is 0.15 mm at a minimum (0.15 mm to 0.40 mm) as shown in the seventh and eight groups (e1, e1, e1, e2, e2, e2) in the table. In this case, the maximum layout diameter P1 of the inner lead pin segments 28 becomes 14.7 mm.

The minimum outside diameter of the neck to set the gap $\Delta$ between the inner surface of the neck and each projection to 0.5 mm by bending the conductive wires of the conventionally typical stem whose layout diameter of its ten conductive wires is 15.24 mm at the interconnecting wires is obtained as follows from the equation (1):

$$NO=2\Delta+2tG+P0-2\delta+F+2\epsilon.$$

From $\Delta$=0.5 mm, tG=2.0 mm,

P0=15.5 mm, $\delta$=1.1 mm,

F=2.5 mm, and $\epsilon$=0.5 mm, 21.8 mm shown in the tenth group (f2) in the table is acquired as the minimum outside diameter of the neck. At this time, the layout diameter P1 of the inner lead pin segments 28 becomes 13.30 mm.

If the layout diameter P0 of the outer lead pin segments 29 is set to 15.0 mm, the minimum layout diameter P1 of the inner lead pin segments 28 becomes 12.80 mm.

When the stem 13 is constructed in the above-described manner, therefore, it is possible to reduce the neck's outside diameter to 21.8 mm to 23.2 mm for the standard color cathode ray tubes with a neck's outside diameter of 29.1 mm which have widely been put to a practical use so far, thereby reducing the horizontal deflection electric power to 78% to 82% of the horizontal deflection electric power of the color cathode ray tube with an deflection angle of 90°.

Even if the deflection angle is increased to 100° from 90° to shorten the overall length of the color cathode ray tube, an increase in horizontal deflection electric power can be suppressed to 10% or less.

Even if the neck's outside diameter is reduced to make the layout diameter of the outer lead pin segments 29 to 15.24 mm, the same as the layout diameter of the ten conductive wires of the stem for a neck with a nominal value of 29.1 mm, all the voltages necessary for the electron gun with excellent focusing characteristics can be supplied via the conductive stem pins 31 of the stem 13, thereby improving the resolution of the color cathode ray tube. Further, this structure can provide a compatibility with other types of color cathode ray tubes.

Furthermore, the gap between the inner wall of the neck and each projection 32 of the stem 13 can be set equal to or greater than 0.5 mm by setting the inside diameter of the neck to 17.8 mm to 19.2 mm, bending the interconnecting wires 30 of the conductive stem pins 31 and setting the layout diameter of the inner lead pin segments 28 to 12.8 mm to 14.7 mm. This can provide a reliable color cathode ray tube which does not have cracks produced by a heat shock during the manufacture of the color cathode ray tube.

Although each conductive wire of the stem is comprised of an outer pin segment, an inner pin segment and an interconnecting wire made of a Dumet wire in this embodiment, a part of this conductive wire which can be sealed in the glass in an air-tight fashion may be used as the interconnecting wire, or the conductive wire may be comprised of the same member, or two kinds of members or three or more kinds of members.

Constructing the stem in the above-described way can provide various advantages. For example, the diameter of the neck can be made smaller to reduce the power consumption of the deflection yoke that is mounted outside the funnel, thereby reducing the power consumption of the color cathode ray tube. Even if the neck's diameter is made smaller, the voltages necessary for the electron gun with excellent focusing characteristics can be supplied via conductive wires of the stem, leading to an improvement on the resolution of the color cathode ray tube. What is more, a compatibility with other types of color cathode ray tubes can be guaranteed. It is also possible to increase the gap between the inner wall of the neck and each projection which encloses the associated inner pin segment of the stem. This can provide a reliable color cathode ray tube which prevents cracks from being produced by a heat shock.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

a vacuum envelope including a panel having an inner surface and a funnel connected to said panel and having a neck structure;

a screen formed on said inner surface of said panel; and an electron gun assembly for generating three electron beams toward said screen, said electron gun assembly including cathodes for emitting said electron beams, heaters for heating said cathodes and a plurality of electrodes for accelerating and controlling said electron beams from said cathodes, said neck structure including, a neck extending from said funnel, having an end portion and an outer diameter which is not larger than 23.2 mm, a stem structure having a stem for sealing said end portion of said neck and a center axis, said stem welded to said end portion of said neck, an exhaust tube provided integrally on said center axis of said stem structure and led out of said end portion of said neck, a plurality of conductive wires, electrically insulated from one another and penetrating said stem structure in an air-tight fashion, for applying voltages to said heaters, said cathodes and said plurality of electrodes of said electron gun assembly, each of said conductive wires including an inner lead pin segment, an outer lead pin segment and an interconnecting wire, the inner lead pin segments being arranged on a first circumference around said center axis of said stem structure and extended inside said neck, the outer lead pin segments being arranged on a second circumference around said center axis of said stem structure and extended outside said end portion of said neck and the interconnecting wires each connecting the inner lead pin segment to the corresponding outer lead pin segment, said first circumference having a first diameter within a range of 12.8 mm to 14.7 mm and said second circumference having a second diameter within a range of 15.0 to 15.5 mm, and projections, provided integrally on said stem structure, for respectively supporting said inner lead pin segments protruding from said stem structure, said interconnecting wires, formed of a flexible Dumet wire between 2.5 mm and 4 mm in length, being embedded and bent in the respective projections and said stem structure, an amount of bending of the Dumet wire being 1.1 mm or less.

2. The color cathode ray tube according to claim 1, wherein each of said interconnecting wires is thinner than at least one of said inner pin segment and said outer pin segment.

3. The color cathode ray tube according to claim 1, wherein a bent portion of each interconnecting wire is located in the respective projection by an amount ranging from 10% to 50% of a height of said projections with said inner surface of said stem structure taken as a reference.

4. The color cathode ray tube according to claim 1, wherein there are nine or more conductive wires.

5. A color cathode ray tube comprising:

a vacuum envelope including a panel having an inner surface and a funnel connected to said panel and having a neck structure;

a screen formed on said inner surface of said panel; and an electron gun assembly for generating three electron beams toward said screen, said electron gun assembly including cathodes for emitting said electron beams, heaters for heating said cathodes and a plurality of electrodes for accelerating and controlling said electron beams from said cathodes, said neck structure including, a neck extending from said funnel and having an inner surface, an end portion and an outer diameter which is not larger than 23.2 mm, a stem structure having an inner surface and a stem for sealing said end portion of said neck and a center axis, said stem welded to said end portion of said neck, an exhaust tube provided integrally on said center axis of said stem structure and led out of said end portion of said neck, and having an inner surface continuously extending into said inner surface of said stem structure via a inflexion portion between both inner surfaces, a plurality of conductive pins, electrically insulated from one another and penetrating said stem structure in an air-tight fashion, for applying voltages to said heaters, said cathodes and said plurality of electrodes of said electron gun assembly, each of said conductive wires including an inner lead pin segment, an outer lead pin segment and an interconnecting wire, the inner lead pin segments being arranged on a first circumference around said center axis of said stem structure and extended inside said neck, the outer lead pin segments arranged on a second circumference around said center axis of said stem structure and extended outside said end portion of said neck, the interconnecting wires each connecting the inner lead pin segment to the corresponding outer lead pin segment, and said first circumference having a first diameter within a range of 12.8 mm to 14.7 mm and said second circumference having a second diameter within a range of 15.0 to 15.5 mm, and projections, provided integrally on said stem structure, for respectively supporting said inner lead pin segments protruding from said inner surface of said stem structure, said interconnecting wires, formed of a flexible Dumet wire between 2.5 mm and 4 mm in length, being embedded and bent in the respective projections and said stem structure, an amount of bending of the Dumet wire being 1.1 mm or less, and a gap between each of said projections and said inner surface of said neck at a middle of a height of that projection with said inflexion portion taken as a reference being set equal to or greater than 0.5 mm.

6. The color cathode ray tube according to claim 5, wherein said neck has an inside diameter of 17.8 mm to 19.2 mm.

7. The color cathode ray tube according to claim 5, wherein each of said interconnecting wires is thinner than at least one of said inner lead pin and said outer lead pin segment.

8. The color cathode ray tube according to claim 5, wherein a bent portion of each interconnecting wire is located in the respective projection by an amount ranging from 10% to 50% of said height of said projections with said inner surface of said stem structure taken as a reference.

9. The color cathode ray tube according to claim 5, wherein there are nine or more conductive wires.

10. A color cathode ray tube comprising:

a vacuum envelope including a panel having an inner surface and a funnel connected to said panel and having a neck structure;

a screen formed on said inner surface of said panel; and an electron gun assembly for generating three electron beams toward said screen, said electron gun assembly including cathodes for emitting said electron beams, heaters for heating said cathodes and a plurality of electrodes for accelerating and controlling said electron beams from said cathodes, said neck structure including, a neck extending from said funnel and having an inner surface, an end portion and an outer diameter which is not larger than 23.2 mm, a stem structure having an inner surface and a stem for sealing said end portion of said neck and a center axis, said stem welded to said end portion of said neck, an exhaust tube provided integrally on said center axis of said stem structure and led out of said end portion of said neck, and having an inner surface continuously extending into said inner surface of said stem structure via an inflexion portion between both inner surfaces, a plurality of conductive wires, electrically insulated from one another and penetrating said stem structure in an air-tight fashion, for applying voltages to said heaters, said cathodes and said plurality of electrodes of said electron gun assembly, each of said conductive wires including an inner lead pin segment, an outer lead pin segment and an interconnecting wire, the inner lead pin segments being arranged on a first circumference around said center axis of said stem structure and extended inside said neck, the outer lead pin segments being arranged on a second circumference around said center axis of said stem structure and extended outside said end portion of said neck, each of the interconnecting wires connecting the inner lead pin segment to the corresponding outer lead pin segment, and said first circumference having a first diameter within a range of 12.8 mm to 14.7 mm and said second circumference having a second diameter within a range of 15.0 to 15.5 mm, and projections, provided integrally on said stem structure, for respectively supporting said inner lead pin segments protruding from said inner surface of said stem structure, said interconnecting wires, formed of a flexible Dumet wire between 2.5 mm and 4 mm in length, being embedded and bent in the respective projections and said stem structure, an amount of bending of the Dumet wire being 1.1 mm or less, and a diameter of each of said projections at a middle of a height of that projection with the inflection portion taken as a reference being set equal to or greater than 2.5 mm, a gap between each projection and said inner surface of said neck at a middle of said height of said projection being set equal to or greater than 0.5 mm.

11. The color cathode ray tube according to claim 10, wherein said neck has an inside diameter of 17.8 mm to 19.2 mm.

12. The color cathode ray tube according to claim 10, wherein each of said interconnecting wires is thinner than at least one of said inner pin segment and said outer pin segment.

13. The color cathode ray tube according to claim 10, wherein a bent portion of each interconnecting wire is located in the respective projection by an amount ranging from 10% to 50% of said height of said projections with the inflexion portion taken as a reference.

14. The color cathode ray tube according to claim 10, wherein there are nine or more conductive wires.

* * * * *